US011708954B2

(12) United States Patent
Sato et al.

(10) Patent No.: US 11,708,954 B2
(45) Date of Patent: Jul. 25, 2023

(54) LAMP UNIT

(71) Applicant: KOITO MANUFACTURING CO., LTD., Tokyo (JP)

(72) Inventors: Ryuho Sato, Shizuoka (JP); Teppei Muramatsu, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 17/482,772

(22) Filed: Sep. 23, 2021

(65) Prior Publication Data

US 2022/0107066 A1 Apr. 7, 2022

(30) Foreign Application Priority Data

Oct. 2, 2020 (JP) ..... 2020-168104

(51) Int. Cl.

| | |
|---|---|
| ***F21S 41/25*** | (2018.01) |
| ***F21S 41/19*** | (2018.01) |
| ***F21S 45/49*** | (2018.01) |
| *F21W 102/13* | (2018.01) |

(52) U.S. Cl.

CPC ..... *F21S 41/25* (2018.01); *F21S 41/192* (2018.01); *F21S 45/49* (2018.01); *F21W 2102/13* (2018.01)

(58) Field of Classification Search

None

See application file for complete search history.

(56) References Cited

U.S. PATENT DOCUMENTS

| | | | | |
|---|---|---|---|---|
| 10,900,630 | B2 * | 1/2021 | Dikau | F21S 41/24 |
| 2015/0103545 | A1 * | 4/2015 | Kato | F21S 41/40 362/509 |
| 2017/0292671 | A1 * | 10/2017 | Gousset-Rousseau | F21S 41/285 |
| 2019/0086050 | A1 * | 3/2019 | Dikau | F21S 41/322 |
| 2020/0132268 | A1 * | 4/2020 | Zhang | F21S 41/153 |
| 2020/0263848 | A1 * | 8/2020 | Gousset-Rousseau | F21S 41/285 |
| 2021/0003263 | A1 * | 1/2021 | Taudt | F21S 41/365 |
| 2021/0310628 | A1 * | 10/2021 | Li | F21S 41/322 |
| 2021/0381668 | A1 * | 12/2021 | Iwasaki | F21S 41/151 |

FOREIGN PATENT DOCUMENTS

| | | | | |
|---|---|---|---|---|
| CN | 108534078 B | * | 4/2020 | F21S 41/141 |
| JP | 2020-136096 A | | 8/2020 | |
| JP | 2021111447 A | * | 8/2021 | |

* cited by examiner

*Primary Examiner* — Elmito Breval

(74) *Attorney, Agent, or Firm* — Venjuris, P.C.

(57) ABSTRACT

A lamp unit includes a light source including a plurality of light emitting elements provided in a common substrate; a projection lens that projects light emitted from the light source toward a front of the lamp unit to form a required light distribution pattern; and a light-transmitting body disposed between the light source and the projection lens and that forms a projection image by controlling transmission of light emitted from the light source. The light transmitting body includes a plurality of incident portions that causes light emitted from each of the plurality of light emitting elements to be incident, and the light transmitting body and the substrate are supported by a lens holder that supports the projection lens.

13 Claims, 15 Drawing Sheets

LAMP UNIT

CROSS-REFERENCE TO RELATED APPLICATIONS

This application is based on and claims priority from Japanese Patent Application No. 2020-168104, filed on Oct. 2, 2020, with the Japan Patent Office, the disclosure of which is incorporated herein in its entirety by reference.

TECHNICAL FIELD

The present disclosure relates to a lamp unit including a projection lens.

BACKGROUND

A lamp unit that forms a required light distribution pattern by irradiating light from a light source toward the front of the lamp unit through a projection lens is known in the related art.

Japanese Laid-Open Patent Publication No. 2020-136096 discloses a lamp unit having a configuration in which a plurality of lens that constitutes the projection lens is supported by a common lens holder.

SUMMARY

In a lamp unit including a projection lens, a projection image is formed by light emitted from a light source, and the projection image is projected on an irradiation target surface in front of the unit by the projection lens to form a light distribution pattern as an inverted projected image thereof. However, in order to clearly form the light distribution pattern in a desired shape, it is necessary to accurately form the projection image in the desired shape on a rear side focal plane of the projection lens.

The present disclosure has been made in consideration of the circumstances and, the present disclosure is to provide a lamp unit capable of clearly forming a light distribution pattern in the desired shape, in a lamp unit including a projection lens.

The present disclosure is to provide an image forming light transmitting body configured to form a projection image, and then devise a configuration.

A lamp unit according to the present disclosure is configured to form a required light distribution pattern by irradiating light from a light source toward the front of the unit through a projection lens. An image forming light transmitting body configured to form a projection image by controlling transmission of light emitted from the light source is disposed between the light source and the projection lens. The light source is constituted by a plurality of light emitting elements mounted on a common substrate. The image forming light transmitting body includes a plurality of incident portions configured to cause light emitted from each of the plurality of light emitting elements to be incident. The image forming light transmitting body and the substrate are supported by a lens holder configured to support the projection lens.

The "projection lens" may be constituted by a single lens or a plurality of lenses.

The type of the "required light distribution pattern" is not particularly limited, and for example, a headlamp light distribution pattern such as a low beam light distribution pattern or a high beam light distribution pattern, or a drawing light distribution pattern for drawing characteristics or symbols may be adopted.

The "projection image" refers to an image that serves as a source projected by the projection lens when the required light distribution pattern is formed as an inverted projected image, and the specific shape is not particularly limited.

As long as the "light source" is constituted by a plurality of light emitting elements mounted on the common substrate, the specific arrangement of the plurality of light emitting elements or the specific configuration of each of the light emitting elements is not particularly limited.

As long as the "image forming light transmitting body" is configured to form a projection image by controlling transmission of light emitted from the light source, the specific shape thereof is not particularly limited. Further, the specific arrangement of the plurality of incident portions or the specific shape of each of the incident portions is also not particularly limited.

As long as the "lens holder" is configured to support the projection lens, the image forming light transmitting body, and the substrate, the specific support structure for each of them is not particularly limited.

The lamp unit related to the present disclosure is configured to form the required light distribution pattern by irradiating the light from the light source toward the front of the unit through the projection lens. However, the image forming light transmitting body configured to form the projection image by controlling the transmission of the light emitted from the light source is disposed between the light source and the projection lens, and moreover, the light source is constituted by a plurality of light emitting elements mounted on the common substrate, and further, the image forming light transmitting body includes a plurality of incident portions configured to cause the light emitted from each of the plurality of light emitting elements to be incident. As a result, following operation effects may be obtained.

That is, it is possible to form the projection image in a desired shape on the rear side focal plane of the projection lens by appropriately setting the number and the arrangement of the plurality of light emitting elements and the plurality of incident portions, and further, appropriately setting the respective configurations thereof. Then, the light distribution pattern having the desired shape may be formed as the inverted projected image by projecting the projection image on the irradiation target surface in front of the unit by the projection lens.

Further, since the image forming light transmitting body is supported by the lens holder configured to support the projection lens, it is possible to enhance the positional relationship accuracy between the image forming light transmitting body and the projection lens. Therefore, it is possible to easily setting the formation position of the projection image on the rear side focal plane of the projection lens, and thus, the light distribution pattern may be clearly formed.

Further, since the plurality of light emitting elements are mounted on the common substrate, the positional relationship accuracy between the plurality of light emitting elements may be enhanced. Further, since the substrate is supported by the lens holder, the positional relationship accuracy between the plurality of light emitting elements and the image forming light transmitting body may be enhanced. Therefore, it is possible to accurately form the projection image in a desired shape on the rear side focal plane of the projection lens, and thus, the light distribution pattern may be also formed accurately in a desired shape.

As described above, according to the present disclosure, in a lamp unit including a projection lens, a light distribution pattern may be clearly formed in a desired shape.

Further, in the configuration, when all of the projection lens, the image forming light transmitting body, and the lens holder are made of a resin member, and the projection lens and the image forming light transmitting body are configured to be fixed to the lens holder by a laser welding, the number of components of the lamp unit may be minimized, and further, the projection lens and the image forming light transmitting body may be fixed to the lens holder with high positional accuracy.

Further, in the configuration, when a heat sink is provided to dissipate heat generated by the plurality of light emitting elements, and the heat sink is configured to be supported by the lens holder in a state of being in surface contact with the substrate, the configuration of the lamp unit may be simplified, and further, it is possible to sufficiently secure the heat dissipation function for the plurality of light emitting elements.

At this time, when the lens holder is configured to include a positioning portion that positions the heat sink in a direction orthogonal to the front-end direction of the lamp unit, it is possible to reliably support the heat sink even though the weight of the heat sink is increased in order to enhance the heat dissipation function thereof.

Further, at this time, when the substrate and the heat sink are configured to be supported by the lens holder by mechanical fastening, it is possible for the heat sink and the substrate to be reliably supported by the lens holder in a state where the heat sink and the substrate are in surface contact with each other.

The specific configuration for the "mechanical fastening" is not particularly limited, and for example, screw fastening, lance engagement, spring fastening, clip fastening, and caulking may be adopted.

Further, in the configuration, when the image forming light transmitting body is configured to include at least one first incident portion and at least one second incident portion as the plurality of incident portions, and is configured to simultaneously form a low beam light distribution pattern by incident light from the at least one first incident portion, and a high beam light distribution pattern by incident light from the at least one first incident portion and the at least one second incident portion, it is possible to clearly form each of the low beam light distribution pattern and the high beam light distribution pattern in a desired shape, and to enhance the positional relationship accuracy between the low beam light distribution pattern and the high beam light distribution pattern.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Hereinafter, an embodiment of the present disclosure will be described with reference to drawings.

Figure 1:
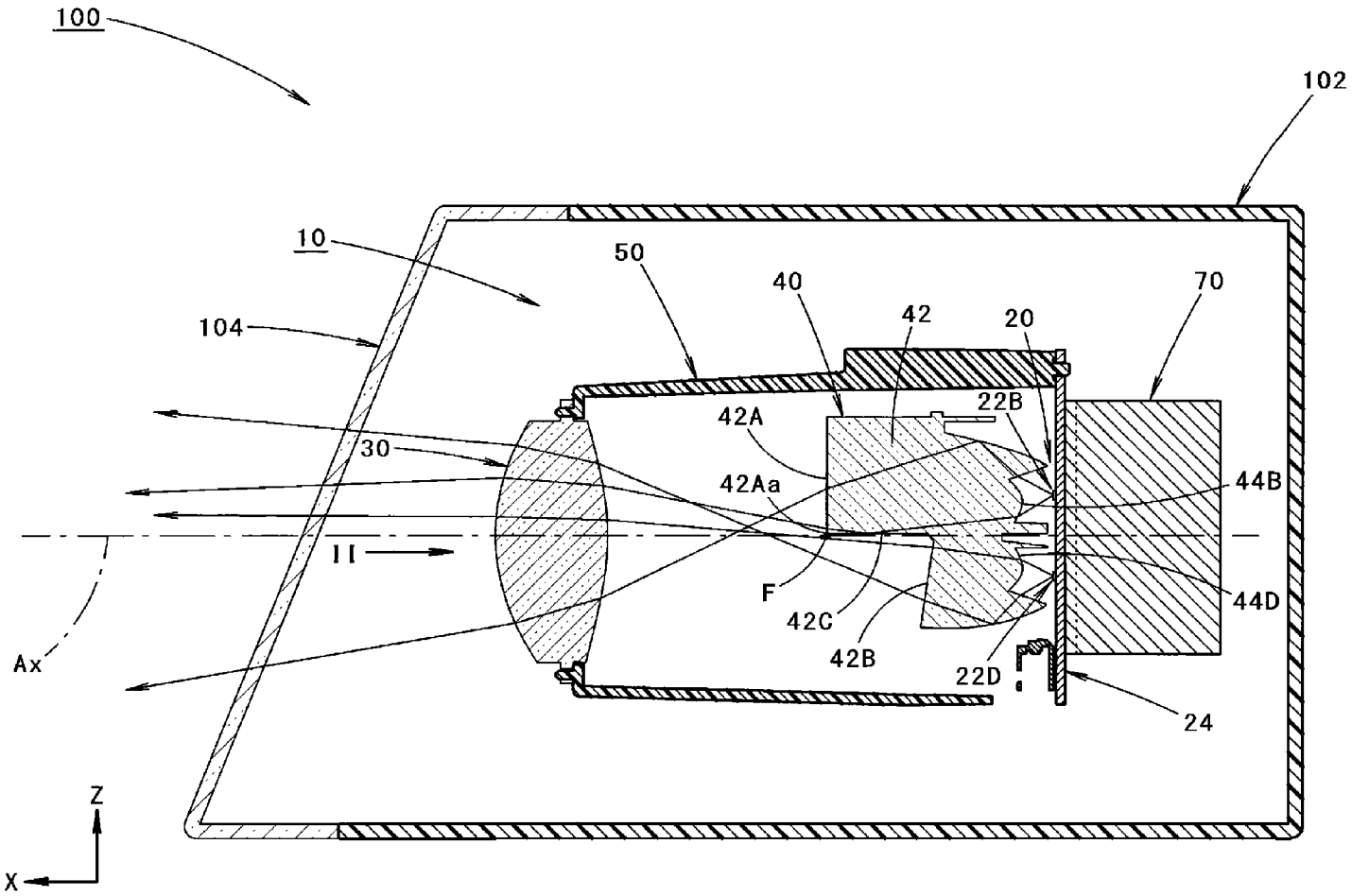
FIG. 1 is a side cross-sectional view illustrating a vehicle lamp including a lamp unit related to an embodiment according to the present disclosure.
Figure 2:
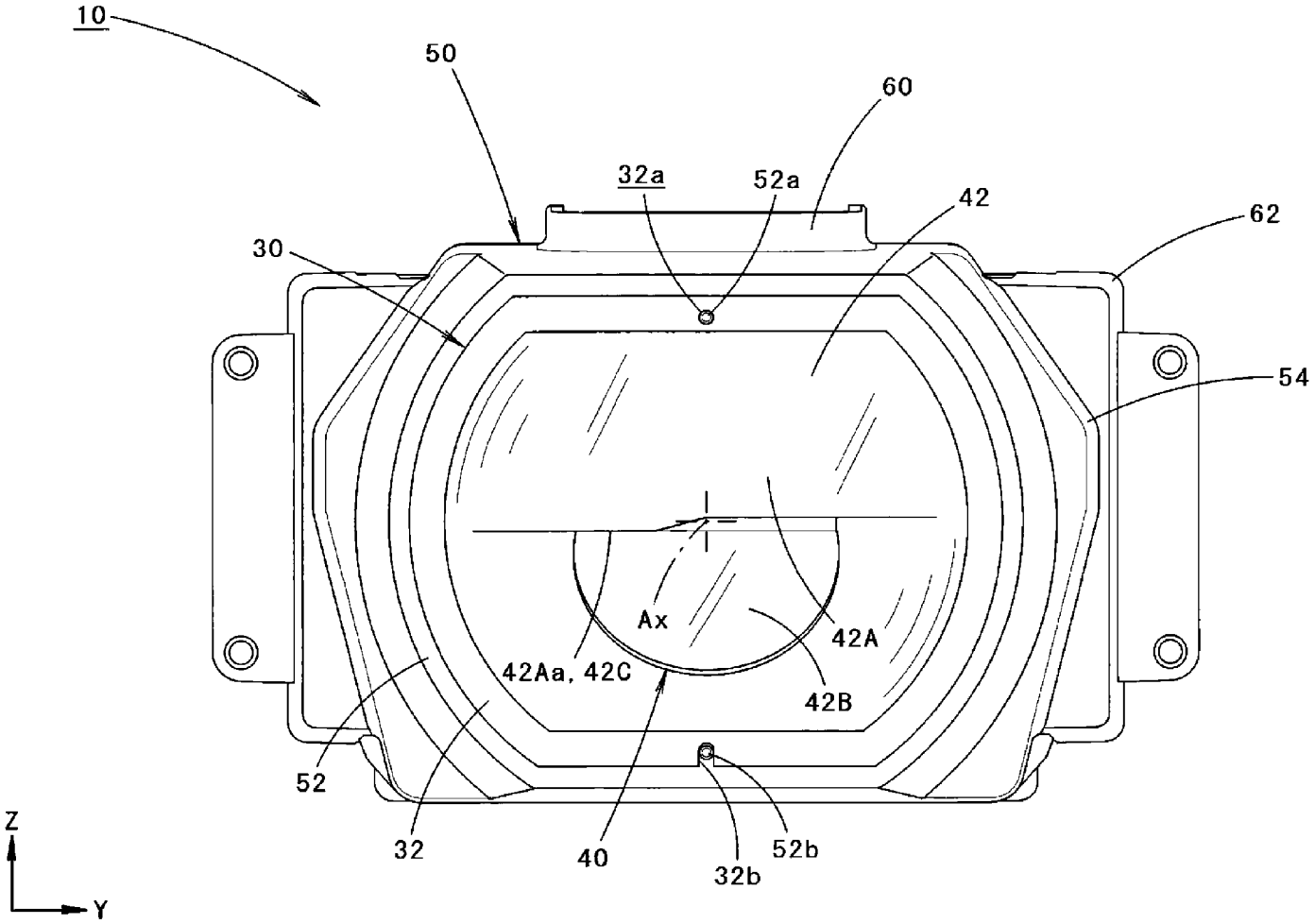
FIG. 2 is a view viewed in II direction of FIG. 1.

FIG. 1 is a side cross-sectional view illustrating a vehicle lamp 100 including a lamp unit 10 related to an embodiment according to the present disclosure. Further, FIG. 2 is a view viewed in II direction of FIG. 1.

In the drawings, the direction indicated by X is the "front of the unit", the direction indicated by Y is the "left direction" orthogonal to the "front of the unit" ("right direction" in the front view of the unit), and the direction indicated by Z is the "upper direction." This is also applied to other drawings.

The vehicle lamp 100 is a headlamp provided at the front end portion of a vehicle, and is configured such that the lamp unit 10 is accommodated in a lamp chamber formed by a lamp body 102 and a light transmitting cover 104 in a state where an optical axis is adjusted so that the front-rear direction of the lamp unit 10 (i.e., the front-rear direction of the unit) substantially coincides with the front-rear direction of the vehicle.

The lamp unit 10 is a projector type lamp unit, and is configured so as to irradiate light from a light source 20 toward the front of the unit through a projection lens 30 to form a low beam light distribution pattern and a high beam light distribution pattern (to be described later).

The projection lens 30 has an optical axis Ax extending in the front-rear direction of the unit, and is configured to form the light distribution pattern by invertedly projecting a projection image formed on the rear side focal plane of the projection lens 30.

An image forming light transmitting body 40 configured to control the transmission of light emitted from the light source 20 to form a projection image is disposed between the projection lens 30 and the light source 20 disposed on the rear side of the unit.

Figure 3:
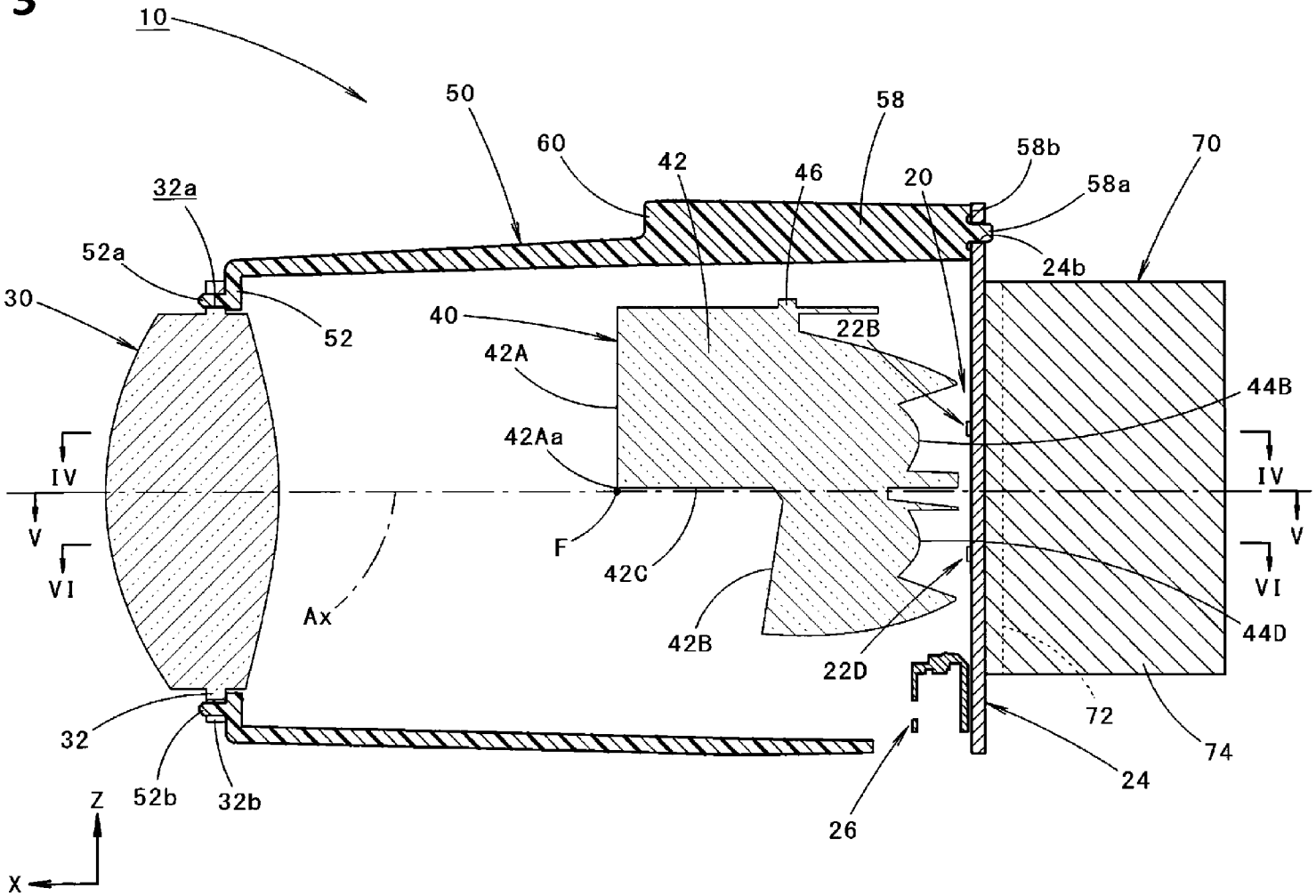
FIG. 3 is a side cross-sectional view illustrating the lamp unit as a single item.
Figure 4:
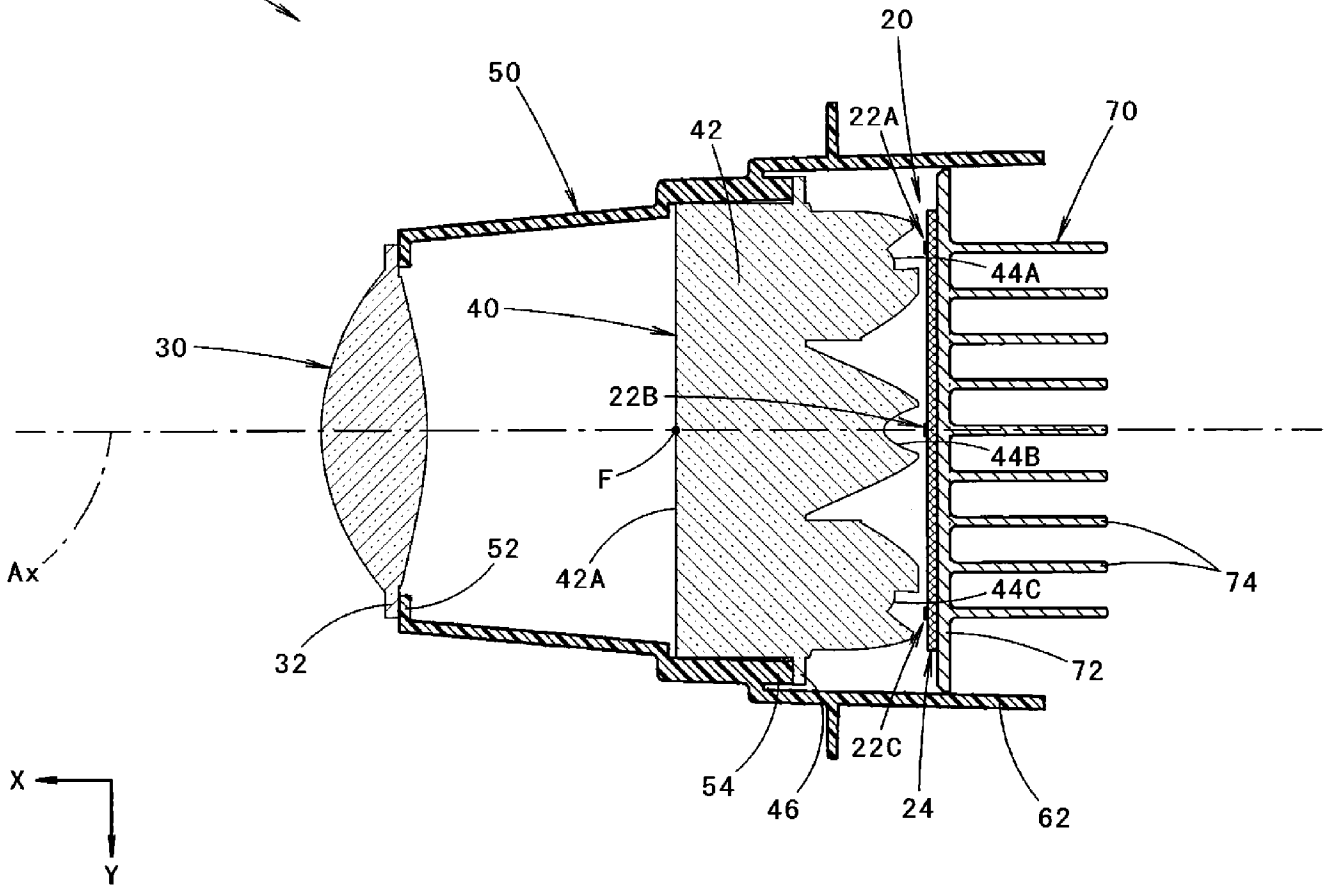
FIG. 4 is a cross-sectional view taken along line IV-IV of FIG. 3.
Figure 5:
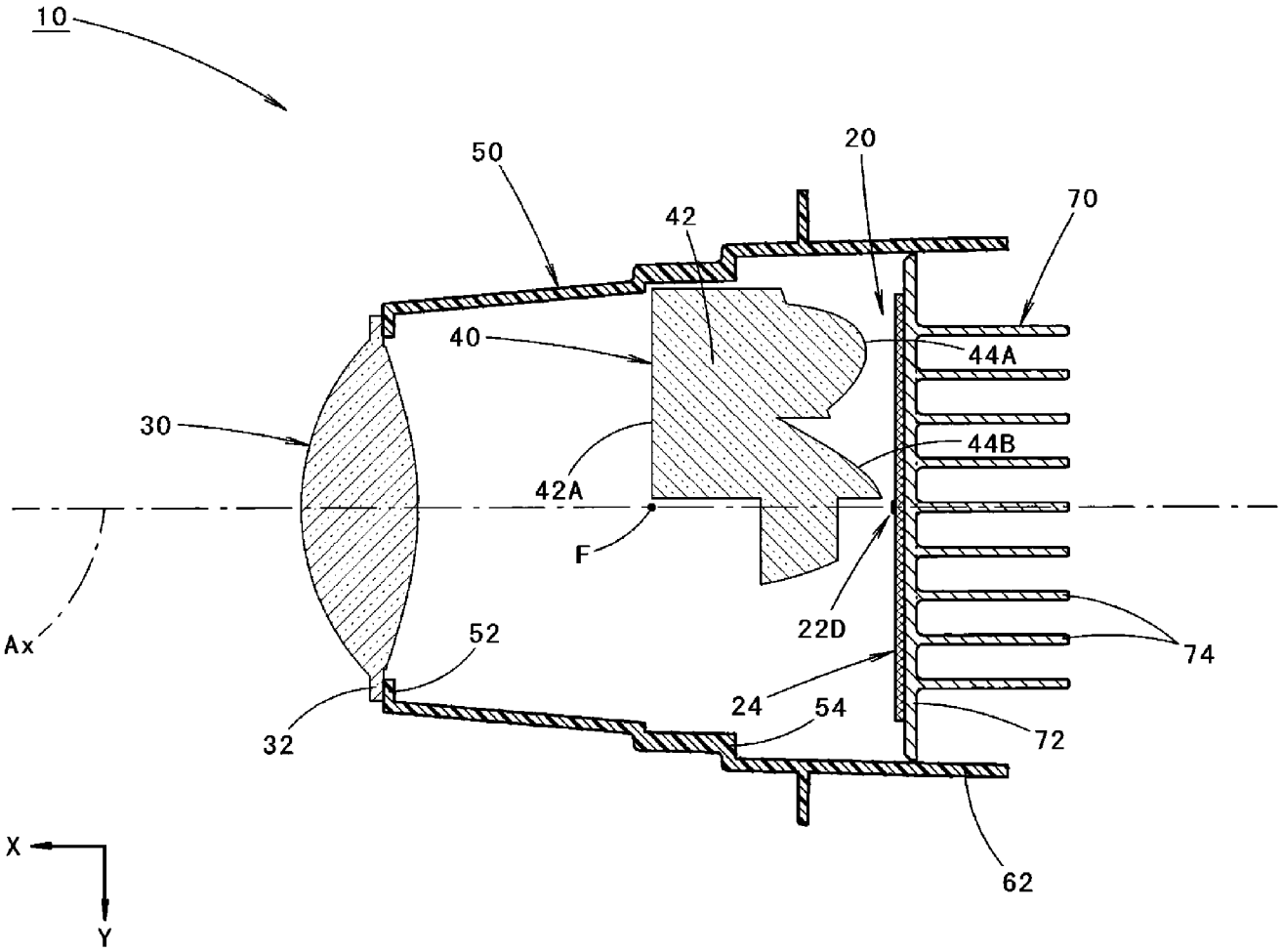
FIG. 5 is a cross-sectional view taken along line V-V of FIG. 3.
Figure 6:
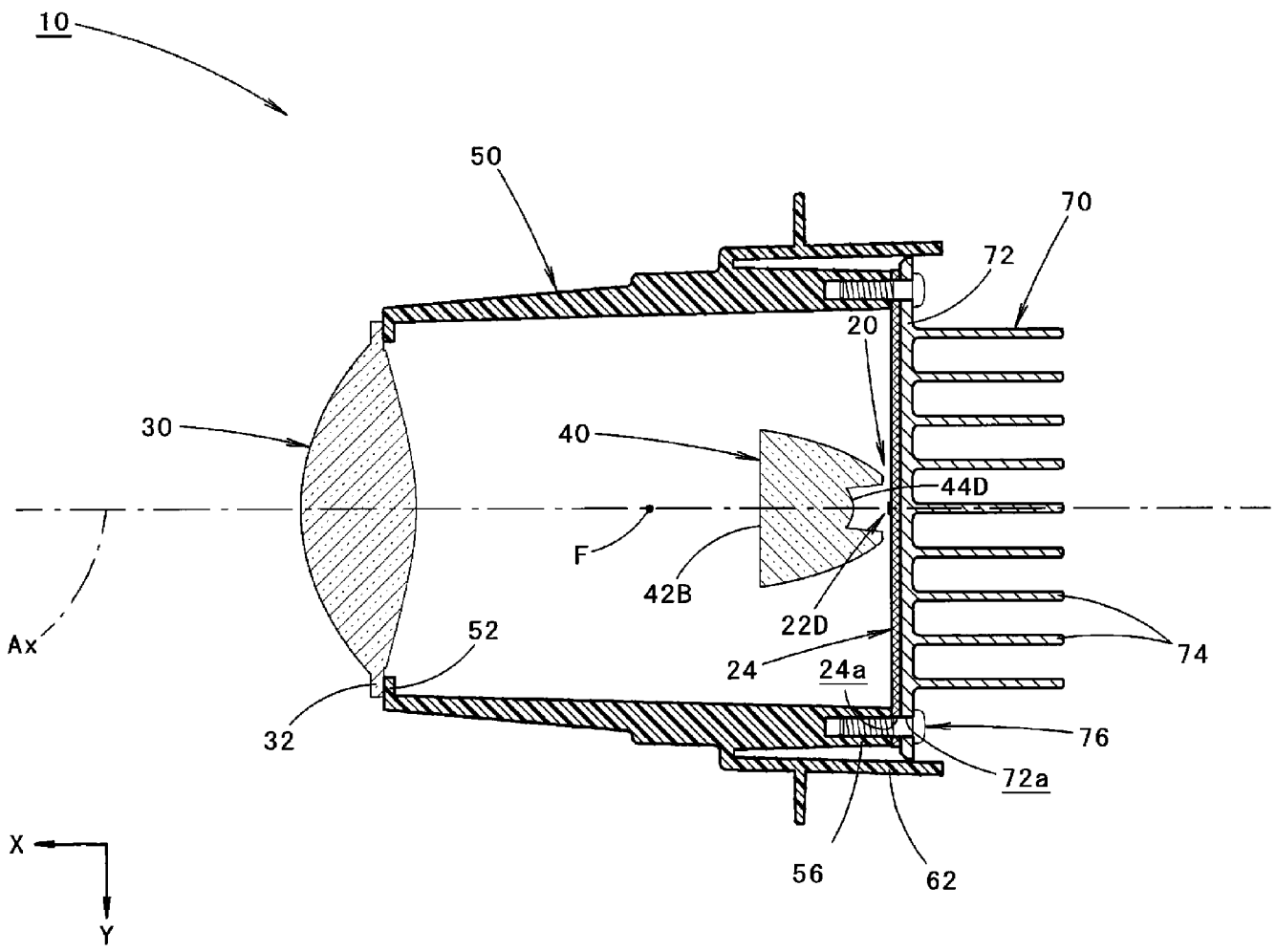
FIG. 6 is a cross-sectional view taken along line VI-VI of FIG. 3.
Figure 7:
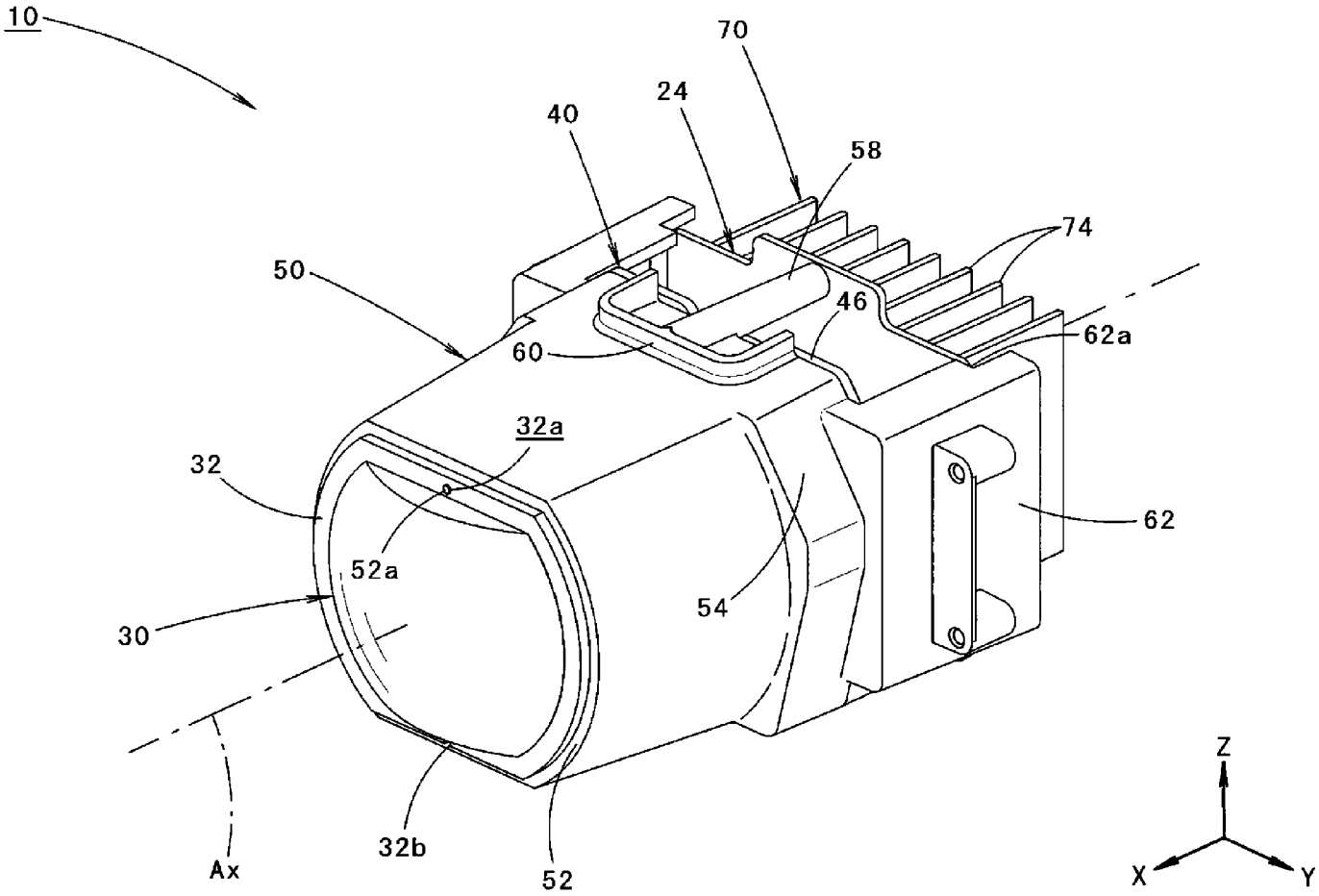
FIG. 7 is a perspective view illustrating the lamp unit as viewed obliquely from the front.
Figure 8:
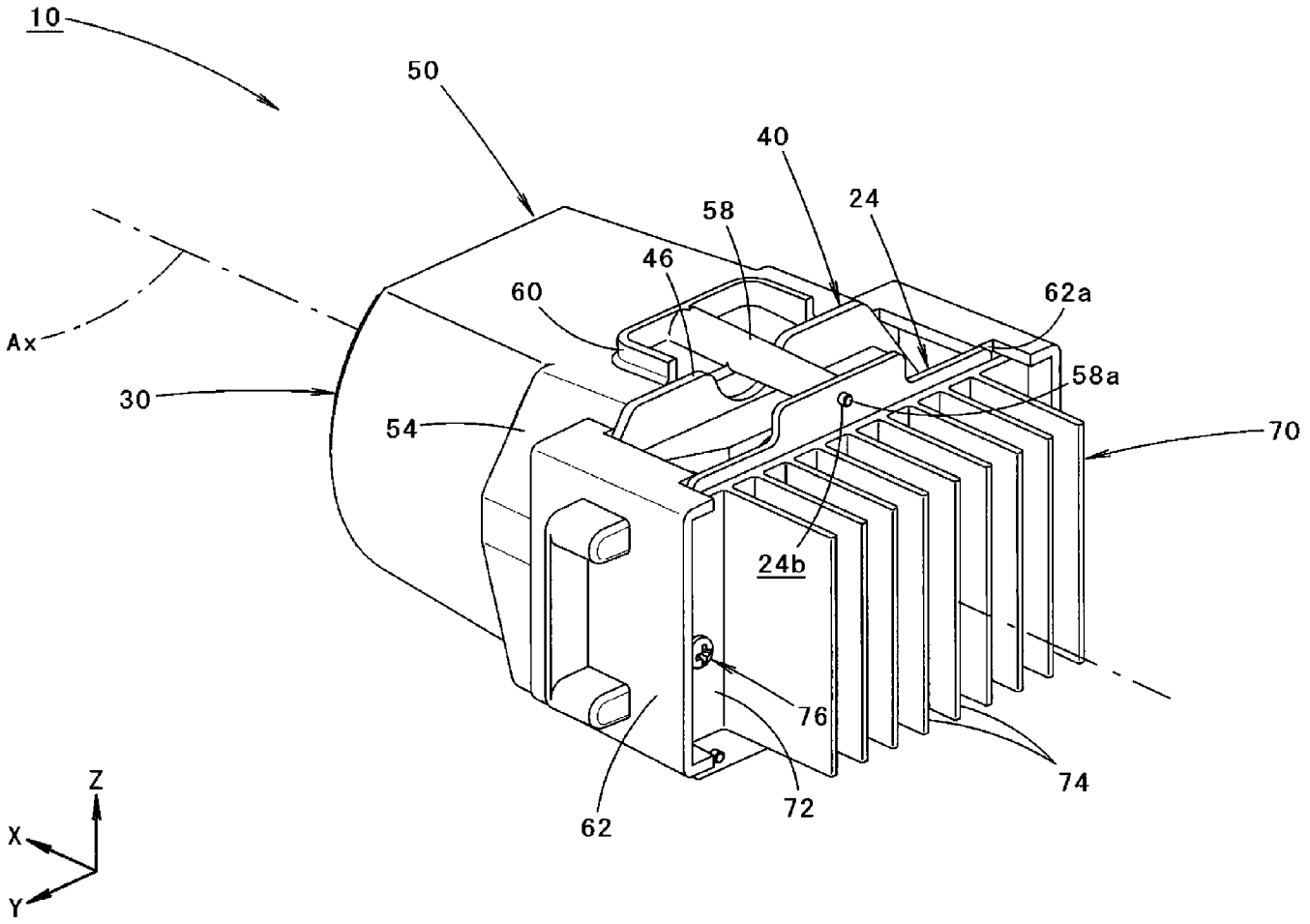
FIG. 8 is a perspective view illustrating the lamp unit as viewed obliquely from the back.
Figure 9:
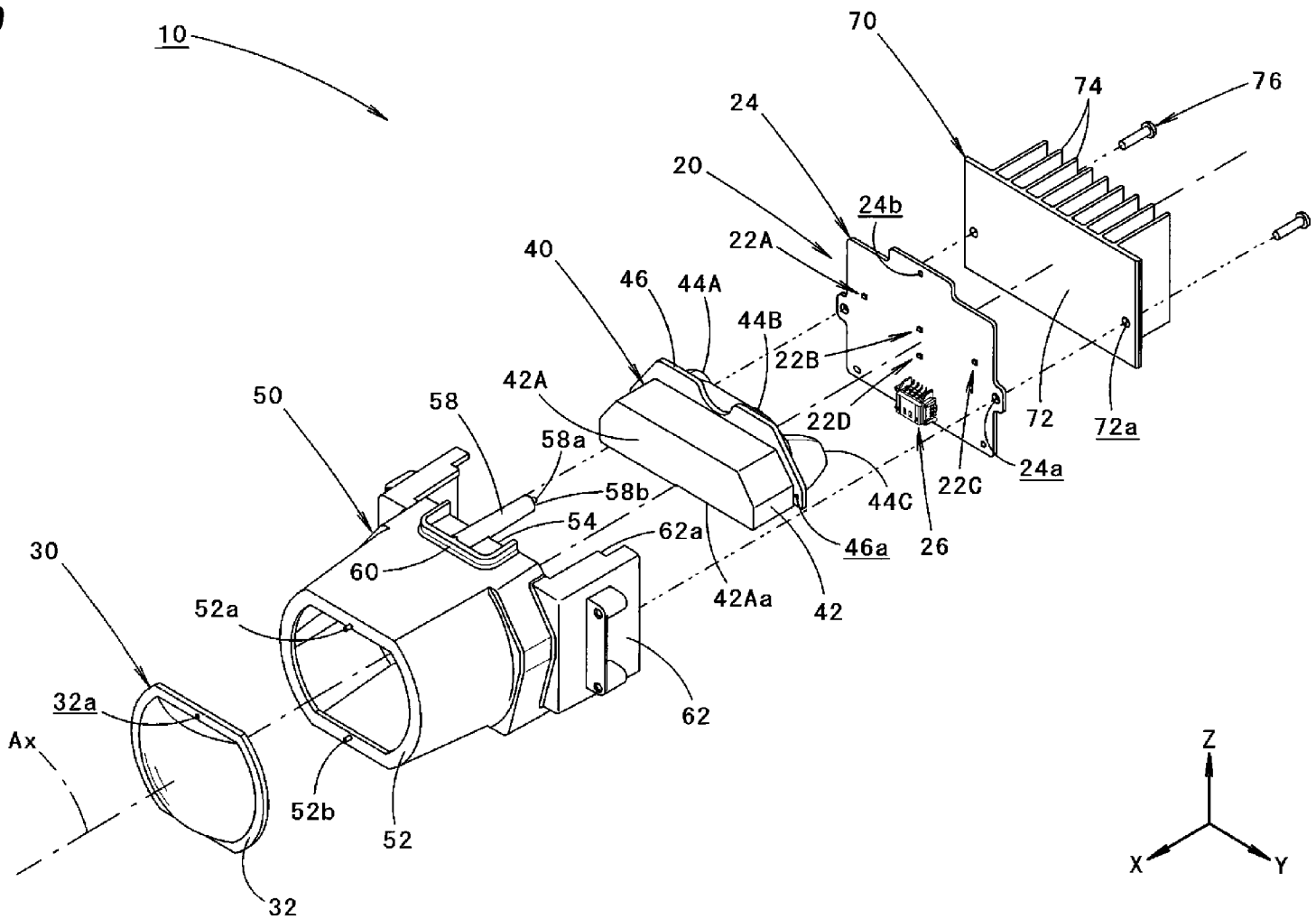
FIG. 9 is an exploded perspective view illustrating the lamp unit as viewed obliquely from the front.
Figure 10:
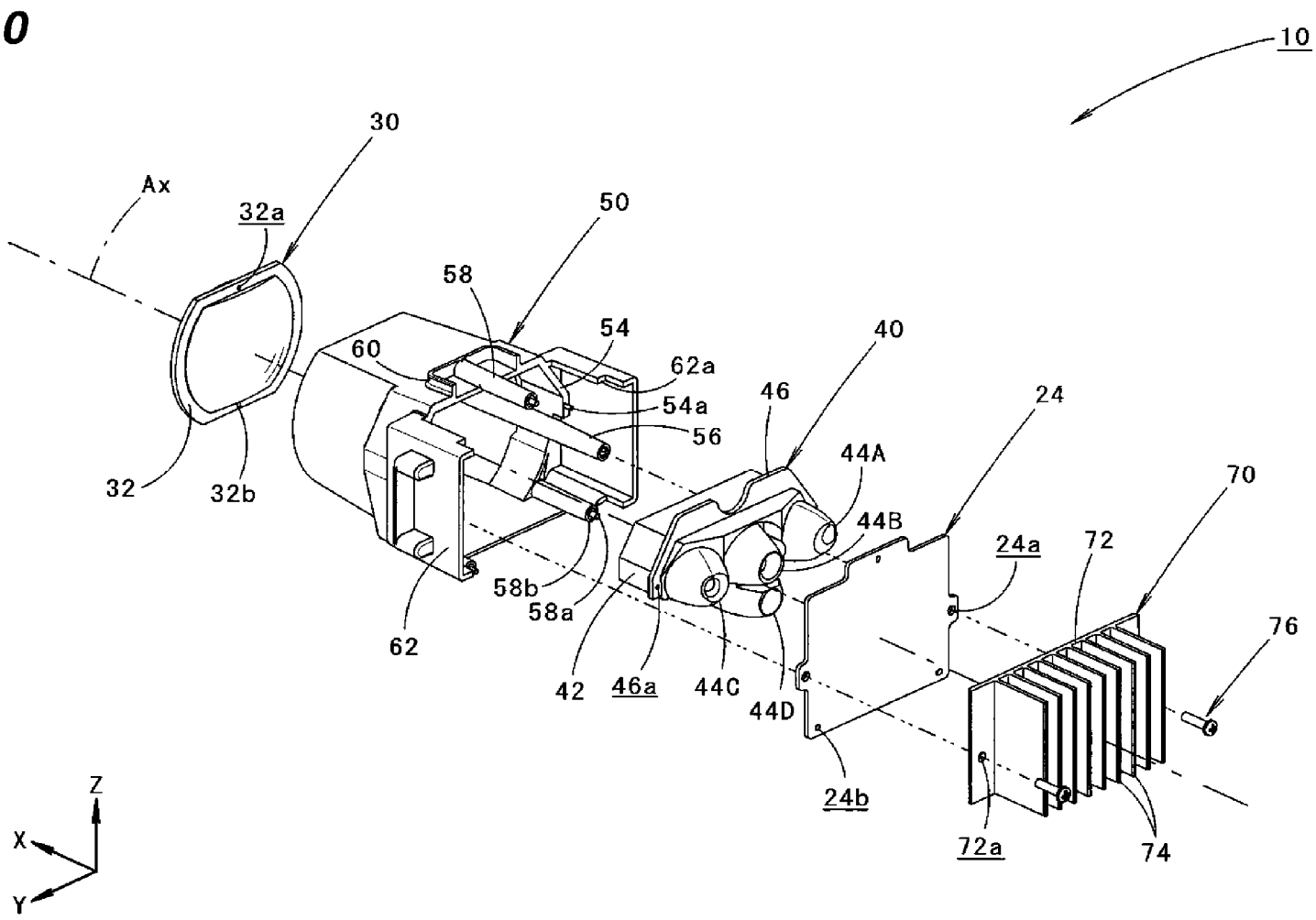
FIG. 10 is an exploded perspective view illustrating the lamp unit as viewed obliquely from the back.

FIG. 3 is a side cross-sectional view illustrating the lamp unit 10 as a single item. Further, FIG. 4 is a cross-sectional view taken along line IV-IV of FIG. 3, FIG. 5 is a cross-sectional view taken along line V-V of FIG. 3, and FIG. 6 is a cross-sectional view taken along line VI-VI of FIG. 3. Further, FIG. 7 is a perspective view illustrating the lamp unit 10 as viewed obliquely from the front, and FIG. 8 is a perspective view illustrating the lamp unit 10 as viewed obliquely from the back. Further, FIG. 9 is a perspective view illustrating the lamp unit 10 as viewed obliquely from the front, and FIG. 10 is a perspective view illustrating the lamp unit 10 as viewed obliquely from the back.

As illustrated in these drawings, the projection lens 30 is a biconvex aspherical lens having an outer peripheral flange portion 32, and is made of a colorless and transparent acrylic resin member. The projection lens unit 30 is supported by the lens holder 50 at the outer peripheral flange portion 32.

The lens holder 50 is a tubular member extending in the front-rear direction of the unit, and is made of an opaque polycarbonate resin member. An annular-shaped lens support 52 is formed at the front end portion of the lens holder 50.

The projection lens 30 is fixed to the lens holder 50 by laser welding in a state where the outer peripheral flange portion 32 is pressed against the lens support 52 of the lens holder 50 from the front side of the unit. The laser welding is performed by irradiating laser light from the front side of the unit.

At this time, a pair of upper and lower positioning pins 52*a* and 52*b* formed in the lens support 52 of the lens holder 50 are engaged with a positioning hole 32*a* and a positioning hole 32*b* formed in the upper portion and the lower portion of the outer peripheral flange portion 32 of the projection lens 30. As a result, the projection lens 30 is positioned in the direction orthogonal to the front-rear direction of the unit with respect to the lens holder 50.

The light source 20 is constituted by four light emitting elements 22A, 22B, 22C, and 22D mounted on a common substrate 24. All of the four light emitting elements 22A to 22D are white light emitting diodes having a horizontally long rectangular light emitting surface, and are disposed such that the light emitting surface is facing the front of the unit.

Among the four light emitting elements 22A to 22D, three light emitting elements 22A to 22C are turned-on when forming a low beam light distribution pattern, and the remaining one light emitting element 22D is additionally turned-on when forming a high beam light distribution pattern.

The three light emitting elements 22A to 22C are disposed at a position directly above the optical axis Ax of the projection lens 30 and at positions distant by a certain amount on both the left and right sides of that position, and the light emitting element 22D is disposed at a position directly below the optical axis Ax.

The substrate 24 is supported by the lens holder 50 (to be described later) in a state of being disposed to extend along a vertical plane orthogonal to the optical axis Ax of the projection lens 30.

A connector 26 electrically connected to the four light emitting elements 22A to 22D via a conductive pattern (not illustrated) is mounted at the center of the lower end on the front surface of the substrate 24. Then, a power supply side connector (not illustrated) is attached to the connector 26 so that electric power is supplied to the four light emitting elements 22A to 22D.

The image forming light transmitting body 40 is made of a colorless and transparent acrylic resin member.

The image forming light transmitting body 40 includes a first emission surface 42A configured to form a projection image for a low beam light distribution pattern, and a second emission surface 42B configured to form a projection image for a high beam light distribution pattern.

The first emission surface 42A is positioned above the front surface of the image forming light transmitting body 40, and is formed to extend along the rear side focal plane of the projection lens 30. As illustrated in FIG. 9, the first emission surface 42A has a substantially horizontally long rectangular outer shape in which the left and right upper corners are chamfered, and a lower end edge 42Aa passes near a rear side focal point F of the projection lens 30 and is formed to be different in height between the left side and the right side.

The image forming light transmitting body 40 includes a block portion 42 horizontally extending toward the rear of the unit while maintaining the outer shape of the first emission surface 42A. A lower surface of the block portion 42 is formed as a horizontal surface portion 42C horizontally extending from the lower end edge 42Aa of the first emission surface 42A toward the rear of the unit.

Meanwhile, the second emission surface 42B is positioned in the lower portion of the front surface of the image forming light transmitting body 40, and is formed to extend along a plane slightly inclined backward with respect to the vertical plane orthogonal to the optical axis Ax of the projection lens 30 at a position distant by a certain amount from the rear side focal plane of the projection lens 30 to the rear side of the unit. The second emission surface 42B is positioned direct below the optical axis Ax, and has a substantially horizontally long elliptical outer shape with an upper portion missing.

The image forming light transmitting body 40 includes four incident portions 44A, 44B, 44C, and 44D configured to cause light emitted from each of the plurality of light emitting elements 22A, 22B, 22C, and 22D to be incident. At this time, three incident portions 44A to 44C are formed to be positioned on the front side of the unit with respect to each of the three light emitting elements 22A to 22C, and further, on the rear side of the unit with respect to the block portion 42. Meanwhile, the remaining one incident portion 22D is formed to be positioned on the front side of the unit with respect to the light emitting element 22D, and further, on the rear side of the unit with respect to the second emission surface 42B.

The three incident portions 44A to 44C are configured such that the light emitted from each of the three light emitting elements 22A to 22C is incident, and then, directly or totally reflected, and then, guided into the block portion 42. The block portion 42 is configured to guide the incident light from the three incident portions 44A to 44C to the first emission surface 42A. At this time, the block portion 42 is configured to totally reflect the light that has reached the horizontal surface portion 42C at the horizontal surface portion 42C, and then, guide the light to the first emission surface 42A. Further, the incident portion 44D is configured such that the light emitted from the light emitting element 22D is incident, and then, directly or totally reflected, and then, guided to the second emission surface 42B.

As illustrated in FIG. 1, the light from the light emitting element 22B incident from the incident portion 44B positioned directly above the optical axis Ax to the image forming light transmitting body 40 is emitted from the first emission surface 42A toward the projection lens 30, and is irradiated from the projection lens 30 toward the front of the unit as substantially downward light. It is also applied to the light from the light emitting elements 22A and 22C incident from the incident portions 44A and 44C positioned on the right side and the left side to the image forming light transmitting body 40. Meanwhile, the light from the light emitting element 22D incident from the incident portion 44D to the image forming light transmitting body 40 is emitted from the second emission surface 42B toward the projection lens 30, and is irradiated from the projection lens 30 toward the front of the unit as substantially upward light.

As illustrated in FIGS. 9 and 10, in the image forming light transmitting body 40, an outer peripheral flange portion 46 extending along the vertical plane orthogonal to the optical axis Ax is formed on both the left and right side portions at the rear end portion of the block portion 42. Then, the image forming light transmitting body 40 is supported by the lens holder 50 at the outer peripheral flange portion 46 in a state of being accommodated in the inner space of the lens holder 50.

The lens holder 50 includes a light transmitting body support 54 that extends along the outer peripheral flange portion 46 of the image forming light transmitting body 40.

Then, the image forming light transmitting body 40 is fixed to the lens holder 50 by laser welding in a state where the outer peripheral flange portion 46 is pressed against the rear surface of the light transmitting body support 54 of the lens holder 50 from the rear side of the unit. The laser welding is performed by irradiating laser light from the rear side of the unit.

At this time, a pair of left and right positioning pins 54*a* formed in the light transmitting body support 54 of the lens holder 50 are engaged with a positioning hole 46*a* formed in the outer peripheral flange portion 46 of the image forming light transmitting body 40. As a result, the image forming light transmitting body 40 is positioned in the direction orthogonal to the front-rear direction of the unit with respect to the lens holder 50.

The lamp unit 10 includes a metal (e.g., aluminum) heat sink 70 configured to dissipate heat generated by the four light emitting elements 22A, 22B, 22C, and 22D.

The heat sink 70 includes a body portion 72 extending along the vertical plane orthogonal to the optical axis Ax of the projection lens 30, and a plurality of heat radiating fins 74 extending from the body portion 72 toward the rear of the unit along the vertical plane. Then, the heat sink 70 is supported by the lens holder 50 together with the substrate 24 in a state of being in surface contact with the rear surface of the substrate 24 on the front surface of the body portion 72. At this time, the surface contact between the substrate 24 and the heat sink 70 is performed in a state where grease is applied to the rear surface of the substrate 24 in advance in order to enhance thermal conductivity.

The substrate 24 and the heat sink 70 are supported by the lens holder 50 by mechanical fastening. Specifically, the substrate 24 and the heat sink 70 are fixed to the lens holder 50 by screw fastening at two locations on the left and right sides with respect to the lens holder 50.

The lens holder 50 includes a pair of left and right screw fastening bosses 56, and the substrate 24 and the body portion 72 of the heat sink 70 each include a pair of left and right screw inserting holes 24*a* and 72*a* to which a jointly fastening screw 76 is inserted.

In the lens holder 50, a stepped positioning pin 58 extending toward the rear of the unit is formed at three locations, that is, at a central upper end portion, and left and right lower end portions. Further, in the substrate 24, a positioning hole 24*b* is formed at three locations, that is, the central upper end portion and the left and right lower end portions. Then, a tip end small diameter portion 58*a* of each stepped positioning pin 58 is inserted into each positioning hole 24*b* in the substrate 24, and a tip end planar portion 58*b* of each stepped positioning pin 58 abuts on the substrate 24. As a result, the substrate 24 is positioned in the front-rear direction of the unit and the direction orthogonal to the front-rear direction with respect to the lens holder 50.

At this time, in an upper wall portion of the lens holder 50, a reinforcing rib 60 formed in a substantially U shape so as to be connected to the base end of the stepped positioning pin 58 is formed.

Further, in the lens holder 50, a pair of left and right positioning portions 62 configured to position the heat sink 70 in the direction orthogonal to the front-rear direction of the unit are formed. The positioning portions 62 are formed to extend toward the rear of the unit in a shape that wraps around both the upper and lower end surfaces of the body portion 72 at positions close to both the left and right end surfaces of the body portion 72 of the heat sink 70.

Further, an L shape notch 62*a* is formed in both the upper and lower end portions of the pair of left and right positioning portions 62. Therefore, when the substrate 24 and the heat sink 70 are fixed to the lens holder 50, the substrate 24 abuts on the four notches 62*a*, and is positioned in the front-rear direction of the unit.

Figure 11A:
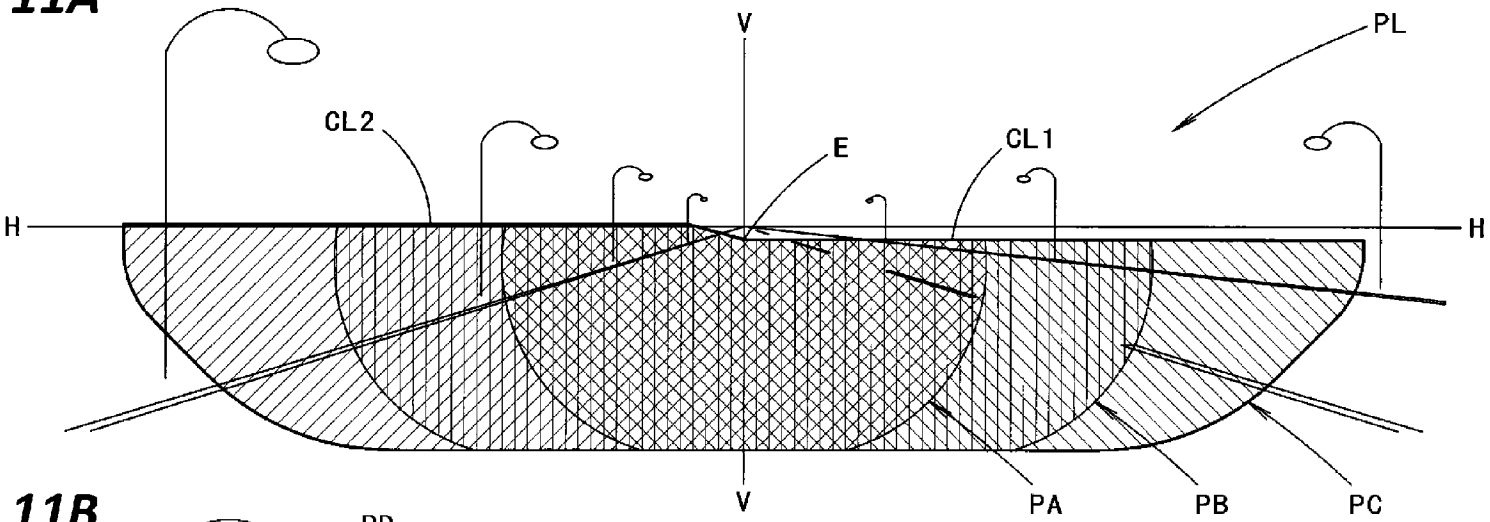
FIGS. 11A and 11B are views illustrating a light distribution pattern formed by irradiation light from the vehicle lamp.
Figure 11B:
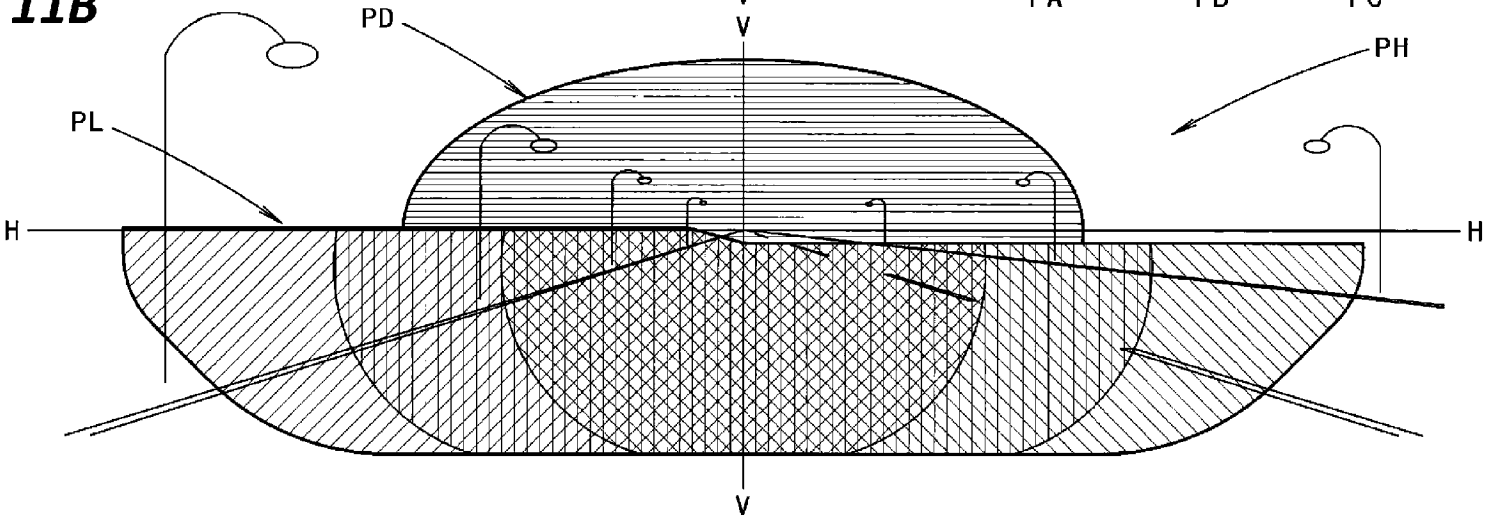

FIGS. 11A and 11B are perspective views illustrating a light distribution pattern formed on a virtual vertical screen disposed at a position 25 m ahead of the vehicle front, by light irradiated from the vehicle lamp 10 toward the front. FIG. 11A is a view illustrating a low beam light distribution pattern PL, and FIG. 11B is a view illustrating a high beam light distribution pattern PH.

As illustrated in FIG. 11A, the low beam light distribution pattern PL is a low beam light distribution pattern of a left side light distribution, and has cut-off lines CL1 and CL2 on the upper end edge thereof which are different in height between the left side and the right side. The cut-off lines CL1 and CL2 extend in the horizontal direction with a difference between the left side and the right side at V-V line as a boundary passing through the H-V which is a vanishing point in vertical direction. A facing lane side portion on the right side of V-V line is formed as the lower end cut-off line CL1, and an own vehicle lane side portion on the left side of V-V line is formed as the upper end cut-off line CL2 which is raised in tier via an inclined portion from the lower end cut-off line CL1. In the low beam light distribution pattern PL, an elbow point E that is an intersecting point of the lower end cut-off line CL1 and V-V line is positioned approximately 0.5° to 0.6° below H-V.

The low beam light distribution pattern PL is formed as a combined light distribution pattern of three light distribution patterns PA, PB, and PC.

Each of the light distribution patterns PA, PB and PC is a light distribution pattern formed as an inverted projected image of the projection image formed on the first emission surface 42A of the image forming light transmitting body 40 by light emitted from each of the light emitting elements 22A, 44B, and 44C. Then, the low beam light distribution pattern PL formed as a combined light distribution pattern is formed to have an outer shape substantially corresponding to the outer shape of the first emission surface 42A of the image forming light transmitting body 40.

At this time, since the image forming light transmitting body 40 is disposed such that the first emission surface 42A is positioned on the rear side focal plane of the projection lens 30, the low beam light distribution pattern PL is formed to have the cut-off lines CL1 and CL2 that are clearly formed.

As illustrated in FIG. 11B, the high beam light distribution pattern PH is configured by adding a high beam additional light distribution pattern PD spreading above the cut-off lines CL1 and CL2 to the low beam light distribution pattern PL.

The high beam additional light distribution pattern PD is a light distribution pattern formed as an inverted projected image of the projection image formed on the rear side focal plane of the projection lens 30 by light from the light emitting element 22D emitted from the second emission surface 42B of the image forming light transmitting body 40. At this time, since the upper end position of the projection image is defined by the lower end edge 42Aa of the first emission surface 42A, the lower end position of the high beam additional light distribution pattern PD is defined by the cut-off lines CL1 and CL2. Therefore, the high beam light distribution pattern PH is formed by connecting the low beam light distribution pattern PL and the high beam additional light distribution pattern PD without a gap.

Next, an action of the present embodiment will be described.

The lamp unit 10 related to the present embodiment is configured to form the low beam light distribution pattern PL and the high beam light distribution pattern PH by irradiating light from the light source 20 toward the front of the unit through the projection lens 30. However, the image forming light transmitting body 40 configured to form a projection image by controlling transmission of light emitted from the light source 20 is disposed between the light source 20 and the projection lens 30. Further, the light source 20 is constituted by the four light emitting elements 22A, 22B, 22C, and 22D mounted on the common substrate 24. Further, the image forming light transmitting body 40 includes the four incident portions 44A, 44B, 44C, and 44D configured to cause light emitted from each of the plurality of light emitting elements 22A to 22D to be incident. As a result, following operation effects may be obtained.

That is, it is possible to form the projection image in a desired shape on the rear side focal plane of the projection lens 30 by appropriately setting the arrangement of the four light emitting elements 22A to 22D and the four incident portions 44A to 44D, and further, appropriately setting the respective configurations thereof. Then, the low beam light distribution pattern PL and the high beam light distribution pattern PH having the desired shape may be formed as the inverted projected image by projecting the projection image on the irradiation target surface in front of the unit by the projection lens 30.

Further, since the image forming light transmitting body 40 is supported by the lens holder 50 configured to support the projection lens 30, it is possible to enhance the positional relationship accuracy between the image forming light transmitting body 40 and the projection lens 30. Therefore, it is possible to easily setting the formation position of the projection image on the rear side focal plane of the projection lens 30, and thus, the cut-off lines CL1 and CL2 of the low beam light distribution pattern PL may be clearly formed.

Further, since the four light emitting elements 22A to 22D are mounted on the common substrate 24, the positional relationship accuracy among the four light emitting elements 22A to 22D may be enhanced. Further, since the substrate 24 is supported by the lens holder 50, the positional relationship accuracy between the four light emitting elements 22A to 22D and the image forming light transmitting body 40 may be enhanced. Therefore, it is possible to accurately form the projection image in a desired shape on the rear side focal plane of the projection lens 30, and thus, the low beam light distribution pattern PL and the high beam light distribution pattern PH may be also formed accurately in a desired shape.

As described above, according to the present embodiment, in the lamp unit 10 including the projection lens 30, the low beam light distribution pattern PL and the high beam light distribution pattern PH may be clearly formed in a desired shape.

Further, in the present embodiment, since all of the projection lens 30, the image forming light transmitting body 40, and the lens holder 50 are made of a resin member, and the projection lens 30 and the image forming light transmitting body 40 are fixed to the lens holder 50 by laser welding, the number of components of the lamp unit 10 may be minimized, and then, the projection lens 30 and the image forming light transmitting body 40 may be fixed to the lens holder 50 with high positional accuracy. Particularly, when adopting laser welding as described above, the positional relationship between the projection lens 30 and the image forming light transmitting body 40 and the lens holder 50 is not changed before and after the welding operation, and thus, the positional accuracy may be maximally enhanced.

Further, the lamp unit 10 related to the present embodiment includes the heat sink 70 configured to dissipate heat generated by the four light emitting elements 22A to 22D, and the heat sink 70 is supported by the lens holder 50 in a state of being in surface contact with the substrate 24. As a result, the configuration of the lamp unit 10 may be simplified, and then, it is possible to sufficiently secure the heat dissipation function for the four light emitting elements 22A, 22B, 22C, and 22D.

At this time, since the lens holder 50 includes the pair of left and right positioning portions 62 configured to position the heat sink 70 in the direction orthogonal to the front-end direction of the unit, even when the weight of the heat sink 70 is increased in order to enhance the heat dissipation function thereof, it is possible to reliably support the heat sink 70.

Further, since the substrate 24 and the heat sink 70 are supported by the lens holder 50 by screw fastening (i.e., mechanical fastening), it is possible for the heat sink 70 and the substrate 24 to be reliably supported by the lens holder 50 in a state of being in surface contact with each other.

Further, the image forming light transmitting body 40 includes three incident portions 44A, 44B, and 44C (first incident portion) and one incident portion 44D (second incident portion) as the four incident portions 44A to 44D, and further, is configured to form the low beam light distribution pattern PL by incident light from the three incident portions 44A to 44C, and at the same time, to form the high beam light distribution pattern PH by the incident light from the three incident portions 44A to 44C and incident light from the incident portion 44D. As a result, it is possible to clearly form each of the low beam light distribution pattern PL and the high beam light distribution pattern PH in a desired shape, and further, to enhance the positional relationship accuracy between the low beam light distribution pattern PL and the high beam light distribution pattern PH.

In the embodiment, the four light emitting elements 22A to 22D have been described as having a horizontally long rectangular shape light emitting surface, but it is also possible to configure to have other outer shapes (e.g., a square shape or a vertically long rectangular shape).

In the embodiment, it has been described that the light source 20 includes the four light emitting elements 22A to 22D and the image forming light transmitting body 40 includes the four incident portions 44A to 44D, but it is also possible to configure to include three or less, or five or more light emitting elements and incident portions.

In the embodiment, the configuration in which the vehicle lamp 100 is a headlamp provided at the front end portion of the vehicle, and the lamp unit 10 is accommodated inside the lamp chamber has been described. However, in addition to this, for example, it is also possible to have a configuration in which the lamp unit 10 is applied to a road surface drawing lamp provided at the bumper position below the headlamp, or a configuration in which the lamp unit 10 is applied to the road surface drawing lamp provided at the rear end portion of the vehicle.

In the embodiment, the lamp unit 10 has been described as a vehicle lamp unit, but it is also possible to use for purposes other than for a vehicle.

Next, modifications of the embodiment will be described.

First, Modification 1 of the embodiment will be described.

Figure 12:
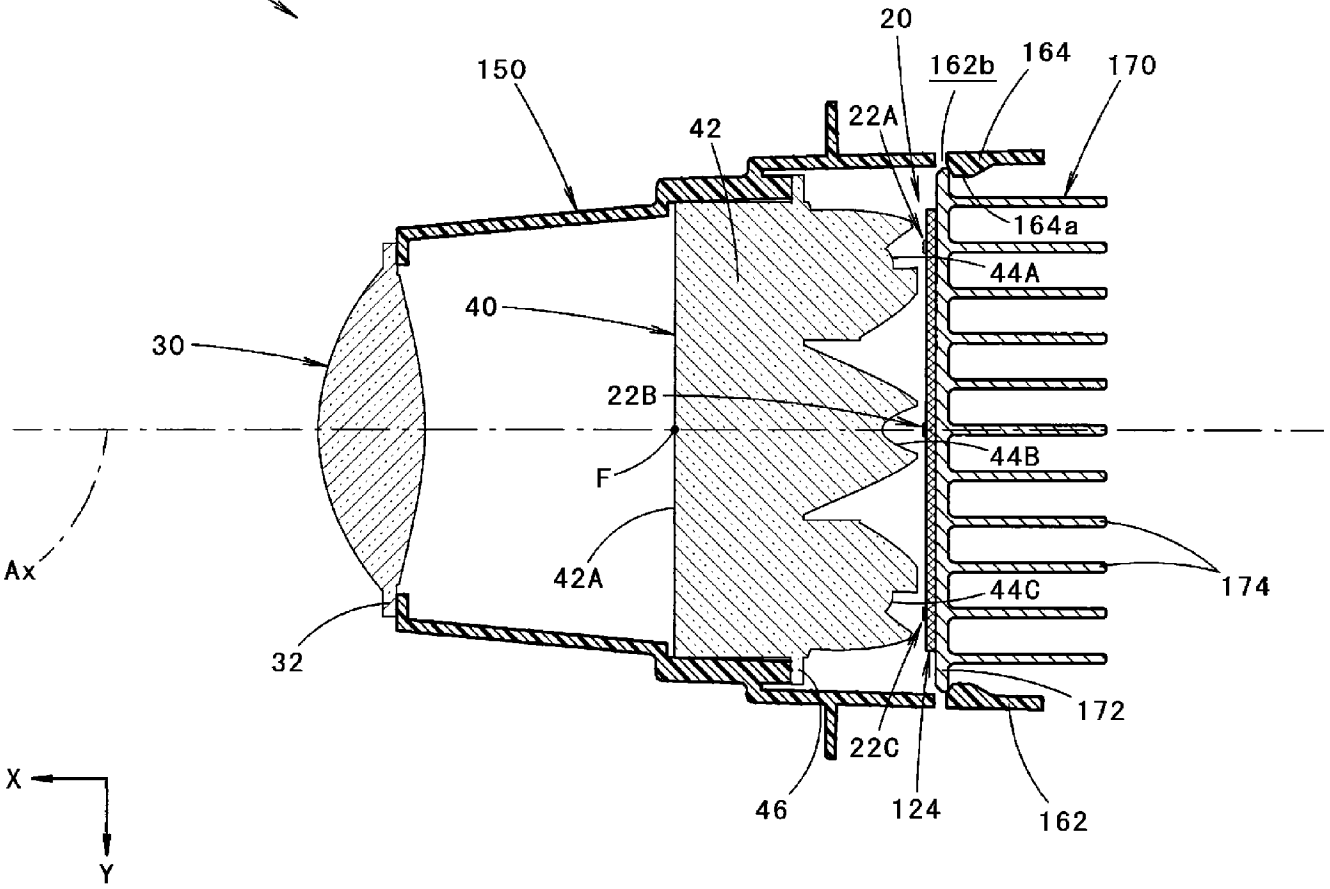
FIG. 12 is a view illustrating Modification 1 of the embodiment, which is similar to FIG. 4.
Figure 13:
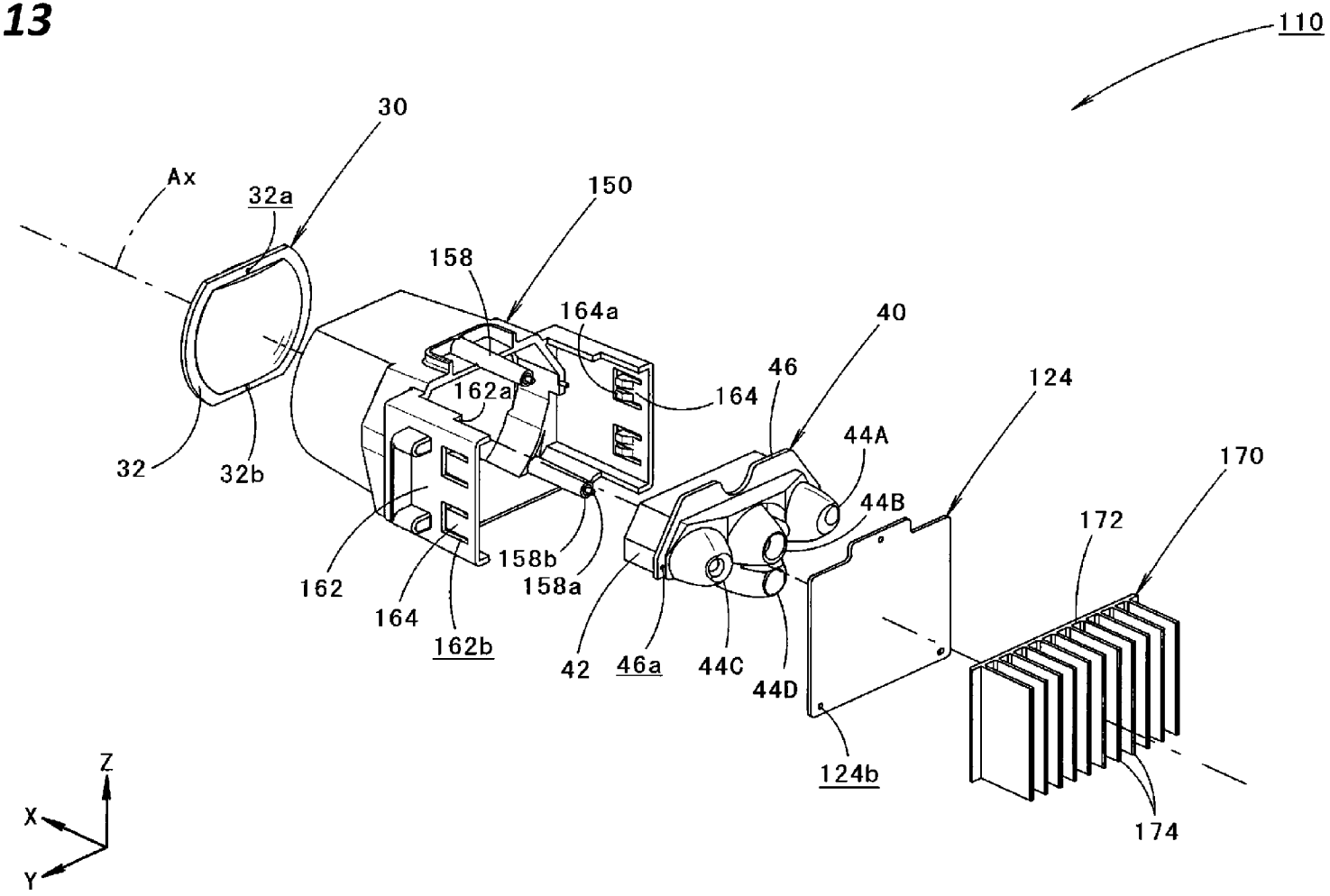
FIG. 13 is a view illustrating Modification 1, which is similar to FIG. 10.

FIGS. 12 and 13 are views illustrating a lamp unit 110 related to Modification 1, which are similar to FIGS. 4 and 10.

As illustrated in FIGS. 12 and 13, Modification 1 is identical in its basic configuration to that of the embodiment. However, the support structure of a substrate 124 and a heat sink 170 with respect to a lens holder 150 is different from that of the embodiment.

That is, also in Modification 1, the aspect that the substrate 124 and the heat sink 170 are supported by the lens holder 150 by mechanical fastening is the same as in the case of the embodiment. However, it is different from the case of the embodiment in that the mechanical fastening is performed by thermal caulking and lance engagement.

Specifically, also in Modification 1, while a tip end small diameter portion 158*a* of a stepped positioning pin 158 formed at three locations in the lens holder 150 is inserted into a positioning hole 124*b* formed at three locations in the substrate 124, a tip end planar portion 158*b* of each stepped positioning pin 158 abuts on the substrate 124. As a result, the substrate 124 is positioned in the front-rear direction of the unit and the direction orthogonal to the front-rear direction with respect to the lens holder 150.

Further, in Modification 1, the tip end small diameter portion 158*a* inserted into the positioning hole 124*b* is thermally caulked, and thus, the substrate 124 is fixed to the lens holder 150.

Further, in Modification 1, each of a pair of left and right positioning portions 162 (i.e., positioning portions configured to position the heat sink 170 in the direction orthogonal to the front-rear direction of the unit) formed in the lens holder 150 is configured to include a pair of upper and lower lance engagement pieces 164.

The lance engagement piece 164 is formed to extend toward the front of the unit in a rectangular shape opening 162*b* formed in the positioning portion 162. At this time, the lance engagement piece 164 is configured such that a tip end portion 164 thereof protrudes on the inner peripheral surface side of the lens holder 150, and further, the rear region of the tip end portion 164*a* is formed in an inclined surface shape.

Then, in a state where the substrate 124 is positioned in the front-rear direction of the unit and the direction orthogonal to the front-rear direction with respect to the lens holder 150, the heat sink 170 is inserted into the inner space of the lens holder 150 from the rear side of the unit and is pushed to the position that abuts on the substrate 124. At this time, the pair of upper and lower lance engagement pieces 164 formed in the pair of left and right positioning portions 162 are elastically deformed such that the tip end portion 164*a* thereof is engaged with a body portion 172 of the heat sink 170, and thus, the heat sink 170 is fixed to the lens holder 150.

Further, also in Modification 1, an L shape notch 162*a* is formed in both the upper and lower end portions of the pair of left and right positioning portions 162. When the substrate 124 and the heat sink 170 are fixed to the lens holder 150, the substrate 124 abuts on the four notches 162*a*.

The screw 76 in the case of the embodiment becomes unnecessary by adopting the configuration of Modification 1, and thus, it is possible to reduce the number of components.

Further, since it is unnecessary to form the screw inserting hole as in the case of the embodiment in the substrate 124 and the body portion 172 of the heat sink 170, it is possible to simplify the configuration of the substrate 124 and the heat sink 170.

Particularly, for the heat sink 170, an extruded product may be used as it is, and further, it is unnecessary to form the screw inserting hole in the body portion 172. As a result, the number of the heat radiating fins 174 may be increased, and thus, the heat dissipation function may be improved.

Further, in Modification 1, since the substrate 124 is fixed to the lens holder 150 by thermal caulking, the heat sink 170 is supported by the lens holder 150 by lance engagement. As a result, even if the positional relationship between the lens holder 150 and the heat sink 170 is slightly deviated, the substrate 124 may be supported by the lens holder 150 with high positional accuracy.

Next, Modification 2 of the embodiment will be described.

Figure 14:
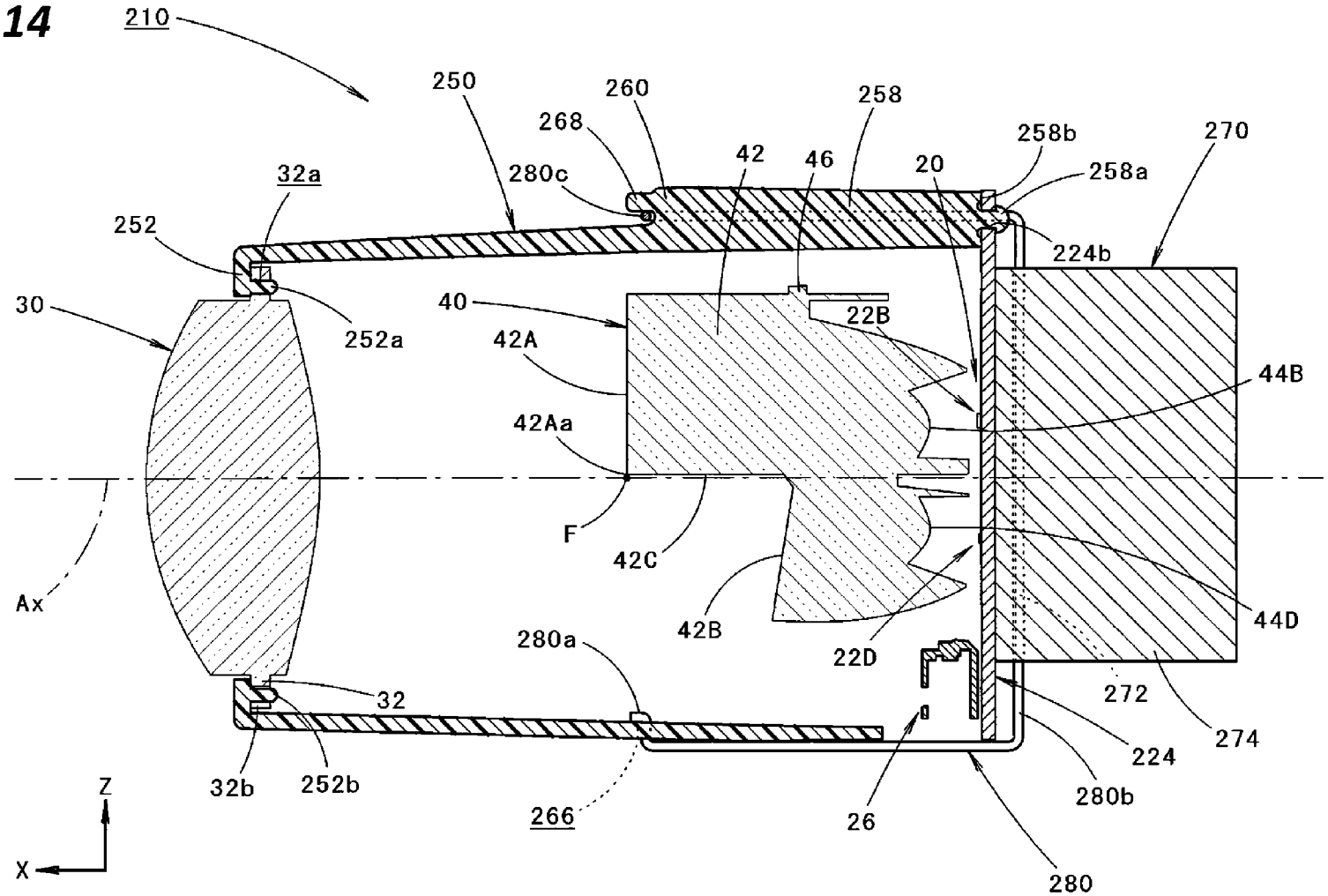
FIG. 14 is a view illustrating Modification 2 of the embodiment, which is similar to FIG. 3.
Figure 15:
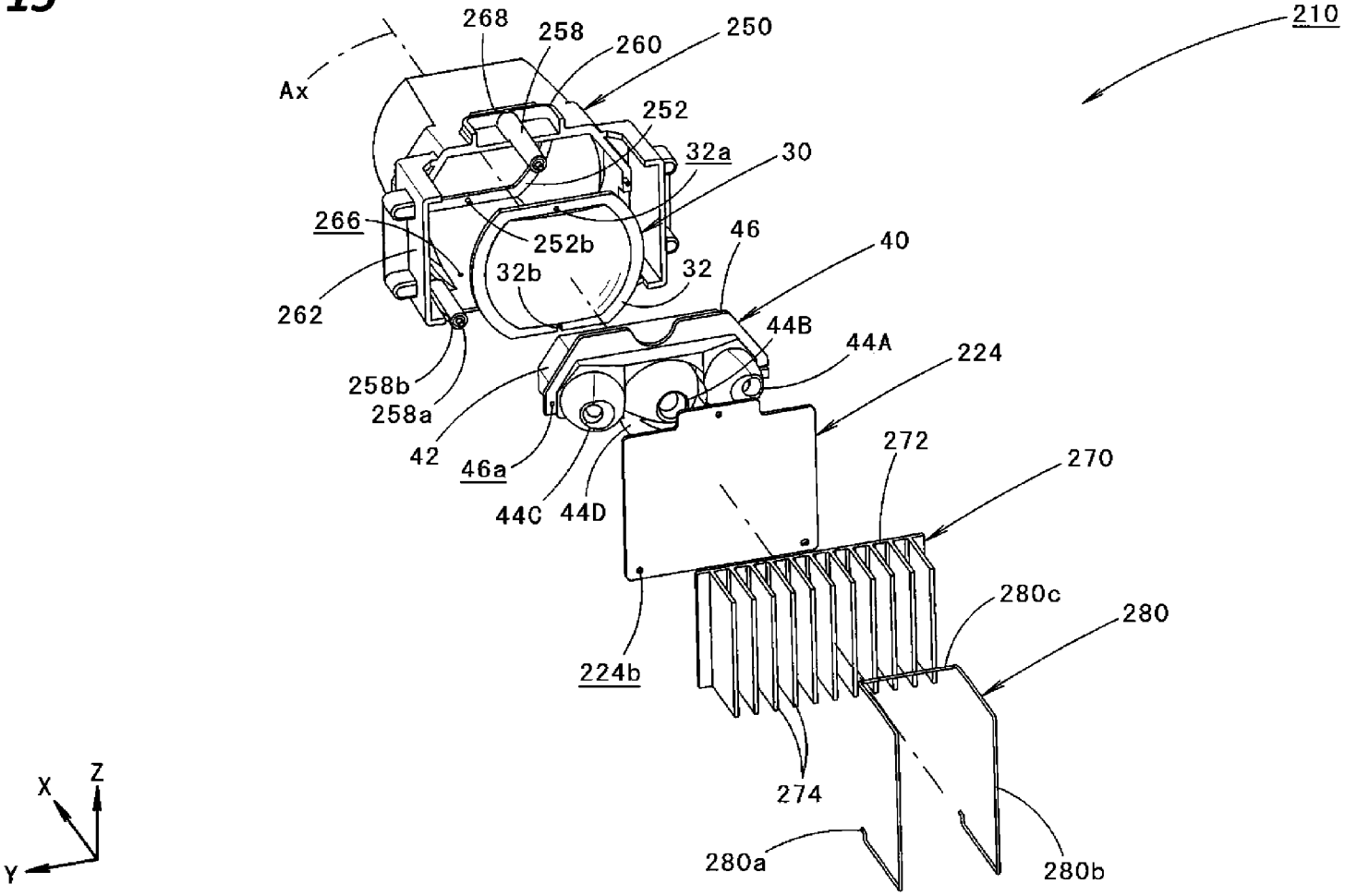
FIG. 15 is a view illustrating Modification 2, which is similar to FIG. 10.

FIG. 14 is a view illustrating a lamp unit 210 related to Modification 2, which is similar to FIG. 3, and FIG. 15 is a view illustrating the lamp unit 210, which is substantially similar to FIG. 10.

As illustrated in FIGS. 14 and 15, Modification 2 is identical in its basic configuration to that of the embodiment. However, the support structure of the projection lens 30 with respect to a lens holder 250 and the support structure of a substrate 224 and a heat sink 270 with respect to the lens holder 250 are different from those of the embodiment.

That is, also in Modification 2, the aspect that the projection lens 30 is supported by the lens holder 250 by laser welding is the same as in the case of the embodiment. However, it is different from the case of the embodiment in that the laser welding is performed by irradiating laser light from the rear side of the unit.

In order to implement the above, the lens holder 250 according to Modification 2 is formed to be slightly longer than the lens holder 50 according to the embodiment. Then, the projection lens 30 is fixed to the lens holder 250 by laser welding in a state where the outer peripheral flange portion 32 is pressed against a lens support 252 of the lens holder 250 from the rear side of the unit.

At this time, similar to the case of the embodiment, a pair of upper and lower positioning pins 252*a* and 252*b* formed in the lens support 252 of the lens holder 250 are engaged with the positioning hole 32*a* and the positioning hole 32*b* formed in the upper portion and the lower portion of the outer peripheral flange portion 32 of the projection lens 30. As a result, the projection lens 30 is positioned in the direction orthogonal to the front-rear direction of the unit with respect to the lens holder 250.

Further, also in Modification 2, the substrate 224 and the heat sink 270 are supported by the lens holder 250 by mechanical fastening. However, it is different from the case of the embodiment in that the mechanical fastening is performed by thermal caulking and spring fastening.

Specifically, also in Modification 2, while a tip end small diameter portion 258*a* of a stepped positioning pin 258 formed at three locations in the lens holder 250 is inserted into a positioning hole 224*b* formed at three locations in the substrate 224, a tip end planar portion 258*b* of each stepped positioning pin 258 abuts on the substrate 224. As a result, the substrate 224 is positioned in the front-rear direction of the unit and the direction orthogonal to the front-rear direction with respect to the lens holder 250.

Further, in Modification 2, the tip end small diameter portion 258*a* inserted into the positioning hole 224*b* is thermally caulked, and thus, the substrate 224 is fixed to the lens holder 250.

Further, in Modification 2, while the heat sink 270 is inserted into the inner space of the lens holder 250 from the rear side of the unit and abuts on the substrate 224, a wire spring 280 is hung on the heat sink 270 and is engaged with both the upper wall portion and the lower wall portion of the lens holder 250 so that the heat sink 270 is fixed to the lens holder 250.

At this time, in the wire spring 280, while a pair of left and right spring end portions 280*a* thereof are engaged with a pair of left and right spring engagement holes 266 formed in the lower wall portion of the lens holder 250, a pair of left and right intermediate portions 280*b* thereof are disposed to be inserted between the heat radiating fins 274 at two positions on the left and right of the heat sink 270 so as to abut on the rear surface of the body portion 272, and a center portion 280*c* thereof is engaged with a spring engagement portion 268 formed in a reinforcing rib 260 of the lens holder 250.

In the state where the heat sink 270 is fixed to the lens holder 250 by the spring engagement as described above, a spring load of approximately 20 to 40 times (e.g., 30 times) the mass of the heat sink 270 is assigned to the wire spring 280.

Since it is unnecessary to form the screw inserting hole as in the case of the embodiment in the substrate 224 and the body portion 272 of the heat sink 270 by adopting the configuration according to Modification 2, it is possible to simplify the configuration of the substrate 224 and the heat sink 270.

Particularly, for the heat sink 270, an extruded product may be used as it is, and further, it is unnecessary to form the screw inserting hole in the body portion 272. As a result, the number of the heat radiating fins 274 may be increased, and thus, the heat dissipation function may be improved.

Further, in Modification 2, since the substrate 224 is fixed to the lens holder 250 by thermal caulking, the heat sink 270 is supported by the lens holder 250 by spring engagement. As a result, even if the positional relationship between the lens holder 250 and the heat sink 270 is slightly deviated, the substrate 224 may be supported by the lens holder 250 with high positional accuracy.

Further, in Modification 2, the lamp unit 210 is configured to be assembled by assembling the projection lens 30, the image forming light transmitting body 40, the substrate 224, the heat sink 20, and the wire spring 280 to the lens holder 250 from the rear side of the unit, and thus, the assembly workability may be improved.

The numerical values shown as specifications in the embodiment and the modifications thereof are merely examples, and, of course, the numerical values may be appropriately set to different values.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A lamp unit comprising:

a light source including a plurality of light emitting sources provided in a common substrate;

a projection lens configured to project light emitted from the light source toward a front of the lamp unit to form a required light distribution pattern; and a light-transmitting body disposed between the light source and the projection lens and configured to form a projection image by controlling transmission of light emitted from the light source, wherein the light-transmitting body includes:

a plurality of incident surfaces configured to receive a plurality of lights emitted from the plurality of light emitting sources, respectively;

an upper emission surface provided at an upper front surface of the light-transmitting body that is positioned above an optical axis of the projection lens, and horizontally extending directly along a focal plane that is positioned at a rear side of the projection lens, the upper emission surface vertically extending with respect to the optical axis of the projection lens when viewed in a vertical cross section; and a lower emission surface provided at a lower front surface of the light-transmitting body that is positioned below the optical axis of the projection lens, and spaced from the upper emission surface in a rear direction of the lamp by a predetermined distance, and wherein the light-transmitting body and the substrate are supported by a lens holder that supports the projection lens.

2. The lamp unit according to claim 1, wherein all of the projection lens, the light-transmitting body, and the lens holder are made of a resin, and the projection lens and the light-transmitting body are fixed to the lens holder by a laser welding.

3. The lamp unit according to claim 2, further comprising:

a heat sink configured to dissipate heat generated by the plurality of light emitting sources, wherein the heat sink is supported by the lens holder in a state of being in surface contact with the substrate.

4. The lamp unit according to claim 3, wherein the lens holder includes a positioning plate configured to position the heat sink in a direction orthogonal to a front-rear direction of the lamp unit.

5. The lamp unit according to claim 4, wherein the lens holder supports the substrate and the heat sink by a mechanical fastening.

6. The lamp unit according to claim 3, wherein the lens holder supports the substrate and the heat sink by a mechanical fastening.

7. The lamp unit according to claim 1, further comprising:

a heat sink configured to dissipate heat generated by the plurality of light emitting sources, wherein the heat sink is supported by the lens holder in a state of being in surface contact with the substrate.

8. The lamp unit according to claim 7, wherein the lens holder includes a positioning plate configured to position the heat sink in a direction orthogonal to a front-rear direction of the lamp unit.

9. The lamp unit according to claim 7, wherein the lens holder supports the substrate and the heat sink by a mechanical fastening.

10. The lamp unit according to claim 8, wherein the lens holder supports the substrate and the heat sink by a mechanical fastening.

11. The lamp unit according to claim 1, wherein the plurality of incident surfaces of the light transmitting body includes at least one first incident surface, and at least one second incident surface provided below the at least one first incident surface, and wherein the light transmitting body is configured to form:

a low beam light distribution pattern by light that is incident from the at least one first incident surface and emitted from the upper emission surface, and a high beam light distribution pattern by light that is incident from the at least one first incident surface and the at least one second incident surface and emitted from the lower inclined emission surface.

12. The lamp unit according to claim 1, wherein the lower emission surface of the light-transmitting body is inclined toward the projection lens as approaching a lower end of the lower emission surface when viewed in a vertical cross section.

13. The lamp unit according to claim 1, wherein the light-transmitting body further includes a horizontal surface extending from a lower end edge of the upper emission surface to an upper end edge of the lower emission surface in the rear direction of the lamp.

* * * * *